United States Patent [19]

Walker et al.

[11] Patent Number: 4,646,479

[45] Date of Patent: Mar. 3, 1987

[54] DEBURRING METHOD

[75] Inventors: Kenneth E. Walker, Smyrna; Anthony V. Forte, Jr., Nashville, both of Tenn.

[73] Assignee: Avco Corporation, Nashville, Tenn.

[21] Appl. No.: 491,990

[22] Filed: May 5, 1983

Related U.S. Application Data

[62] Division of Ser. No. 305,716, Sep. 25, 1981, abandoned.

[51] Int. Cl.[4] ..... B24B 1/00

[52] U.S. Cl. ..... 51/328; 51/34 R; 51/334

[58] Field of Search ..... 51/281 R, 310, 312, 51/326, 34 R, 295, 328; 15/182, 183, 180

[56] References Cited

U.S. PATENT DOCUMENTS

| | | | |
|---|---|---|---|
| 2,049,324 | 7/1936 | Schneider | 51/190 |
| 2,328,998 | 9/1943 | Radford | 51/185 |
| 2,653,340 | 9/1953 | Cave | 15/183 |
| 2,984,053 | 5/1961 | Peterson | 51/193.5 |
| 3,032,931 | 5/1962 | Eversole | 51/34 R |
| 3,064,290 | 11/1962 | Bleke | 15/21 |
| 3,225,389 | 12/1965 | Jones | 15/183 |
| 3,237,348 | 3/1966 | Block | 51/74 |
| 3,241,172 | 3/1966 | Tilgner | 15/183 |
| 3,324,496 | 6/1967 | Haracz | 15/183 |
| 3,547,608 | 12/1970 | Kitazawa | 51/295 |
| 3,605,347 | 9/1971 | Barry | 15/180 |
| 3,613,143 | 10/1971 | Muhler et al. | 51/295 |
| 3,780,407 | 12/1973 | Hoffecker | 15/180 |
| 3,871,139 | 3/1975 | Rands | 51/334 |
| 4,078,905 | 3/1978 | Oya | 51/326 |
| 4,183,183 | 1/1980 | Belanger | 51/334 |
| 4,377,878 | 3/1983 | Pecora | 51/334 |

FOREIGN PATENT DOCUMENTS

| | | | |
|---|---|---|---|
| 0527791 | 7/1956 | Canada | 51/281 R |
| 2206225 | 8/1973 | Fed. Rep. of Germany . | |
| 2519363 | 11/1976 | Fed. Rep. of Germany . | |
| 3020635 | 12/1980 | Fed. Rep. of Germany . | |
| 2021145 | 10/1969 | France . | |
| 2270057 | 5/1975 | France . | |
| 0136789 | 11/1978 | Japan | 51/281 R |
| 50684 | 1/1910 | Switzerland | 15/183 |
| 766145 | 1/1957 | United Kingdom | 51/34 R |
| 1063911 | 4/1967 | United Kingdom . | |
| 1274508 | 5/1972 | United Kingdom . | |
| 1456693 | 11/1976 | United Kingdom . | |
| 1461570 | 1/1977 | United Kingdom . | |
| 1480673 | 7/1977 | United Kingdom . | |
| 264966 | 6/1970 | U.S.S.R. | 15/183 |

*Primary Examiner*—Frederick R. Schmidt
*Assistant Examiner*—Robert A. Rose
*Attorney, Agent, or Firm*—Charles M. Hogan; Robert J. McNair, Jr.; Irwin P. Garfinkle

[57] ABSTRACT

A deburring method is presented wherein a cylindrical brush rotationally contacts the workpiece. The brush includes a mandrel having a central axle to provide support during use. To the mandrel is attached a multiplicity of long bristles. Each bristle is flexible and has impregnated therein a plurality of abrasive particles. The population density of the bristles on the brush is such that the outwardly extending ends can readily flex both in the plane of rotation and sidewise along the lengthwise dimension of the brush. Setting the brush so that the bristle ends overlap the surface of the workpiece being deburred, each bristle makes a slapping contact therewith. This results in one to two inches of each bristle being dragged endwise across the surface of the workpiece. The endwise movement of each bristle causes the abrasive particles imbedded therein to abrade the sharp edges of the workpiece. An automatic conveyor may be used to feed workpiece stock past the rotating brush at a predetermined rate.

6 Claims, 8 Drawing Figures

DEBURRING METHOD

BACKGROUND OF THE INVENTION

This is a division of application Ser. No. 305,716 filed Sept. 25, 1981, now abandoned.

A deburring method and apparatus is disclosed which is particularly suited for use with large extrusions which have been shaped to size by multiple spindle milling machines.

Several automated deburring systems exist in the prior art. U.S. Pat. No. 4,280,304 discloses a method for deburring workpieces by the combined operations of finishing by rotary tools and gyro-finishing. U.S. Pat. No. 4,275,529 discloses a rotative abrasive flap wheel which has been used as a deburring tool in some of the prior art systems.

The general status of the art is presented in the book, "Deburring Technology for Improved Manufacturing" authored by LaRoux K. Gillespie and published by the Society of Manufacturing Engineers, One SME Drive, P.O. Box 930, Dearborn, Mich. 48128, copyright 1981. This text discloses deburring methods used either separately or in combination including: vibration with abrasive media, composite wheels driven by electric or air motors, flap wheels of the type disclosed in U.S. Pat. No. 4,275,529, buffing with Scotch-Brite pads and use of hand held routers and similar cutters.

Many of the methods described in the text were tried. None seemed adaptable to automation in a system capable of handling the various part shapes and sizes present in an aerospace manufacturing facility. It was then discovered that there was an extruded fiber available which consisted of a nylon resin impregnated with abrasive granules. We then determined that this abrasive fiber could be made into a large diameter brush which when rotated at proper speeds in contact with the workpiece did a satisfactory job of deburring.

SUMMARY OF THE INVENTION

The deburring means of this invention utilizes a cylindrically shaped rotating brush having long bristles. The bristles consist of flexible fibers which have impregnated therein abrasive particles. Both aluminum oxide and silicon carbide impregnated bristle fibers were used to carry out the principles of the invention. Use of a conveyance device was found to enhance the deburring of machined parts as they passed beneath the rotating brush.

The objective is to have a brush with long flexible fibers. The population density of fibers on the brush is such that the outwardly extending ends can readily flex both axially and in the plane of rotation. The goal is to have each brush fiber slap against the sharp edge of the workpiece. Due to brush rotation the fibers, after making a slapping contact with the workpiece, are dragged endwise across the surface. With abrasive particles embedded in each fiber, the endwise movement of the fibers creates a rasp like action which abrades the sharp edges of the workpiece. By using a large diameter brush having long flexible fibers extending therefrom, changes in workpiece contour can be accommodated.

It was discovered advantageous to rotate the brush at a relatively slow speed so that the abrasive impregnated fibers are dragged over the surfaces to be deburred at rates of about 3000 feet per minute (600 rpm times $\pi D$ where D equals a 20 inch diameter brush). Secondly, it was found beneficial to cyclically move the brush back and forth endwise over a span of several inches. This assures that the bristle fibers of the rotating brush always have some motion which is operating crosswise to the edges present on the face of the workpiece. Typical endwise oscillatory motion of the brush is 30-to-50 cycles per minute. For a 22 inch diameter brush rotating at 600-to-700 rpm and oscillating back and forth endwise some 3 inches, it was found that large aluminum extrusions would be deburred when passed under the abrasive fibers at a feed rate of 3 ft. per minute. Aluminum oxide abrasive particles embedded in 40 mil diameter fibers were used in the above implementation.

For the deburring system which was reduced to practice, an automatic conveyor unit was used which included switches for starting and sequencing events. To use the system, an operator feeds a piece of machined stock into the input end of the deburring equipment. The automatic conveyor then takes over, with switches turning on means for positively transporting the stock to be deburred under the rotating brush. The conveyor advances the stock at a constant rate under the rotating brush while at the same time supporting it in a steady fashion.

DESCRIPTION OF THE PREFERRED EMBODIMENT

Figure 1:
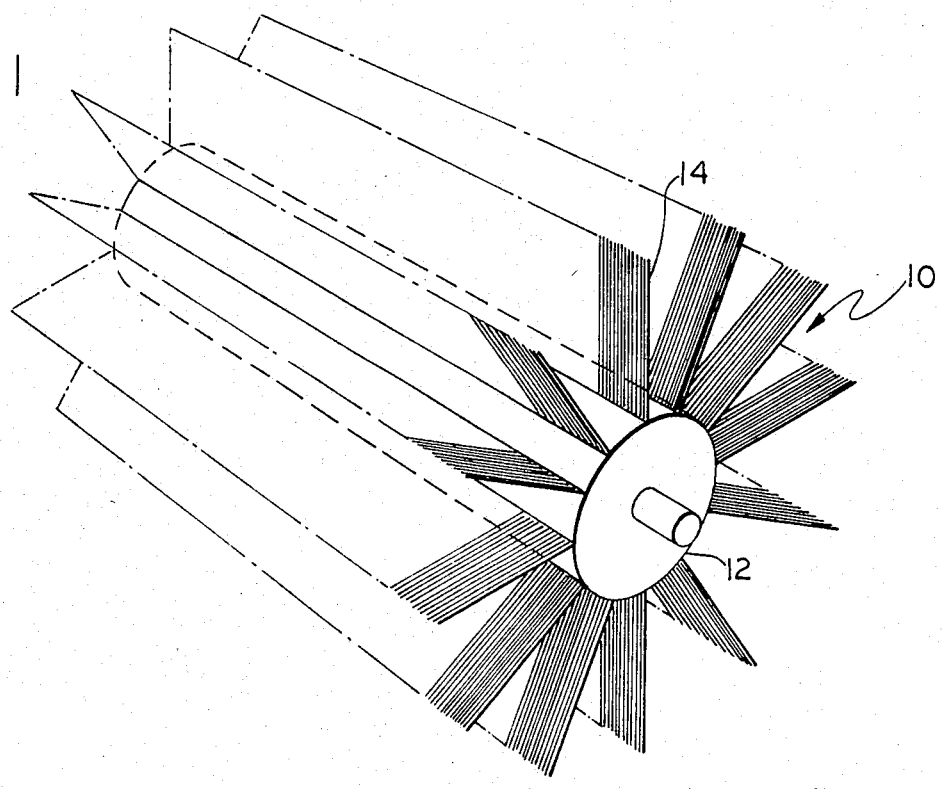
FIG. 1 is a perspective view of a cylindrical shaped brush configured according to the principles of this invention.

In FIG. 1 is illustrated a brush 10 which incorporates the principles of our invention. Brush 10 includes a mandrel 12 which carries a multiplicity of rows of abrasive impregnated fibers 14. In the unit reduced to practice the diameter of mandrel 12 was approximately 6 inches and the fibers 14 extended outward about 8 inches from the mandrel, thereby producing a cylindrical brush that had an overall diameter of 22 inches. The length of mandrel 12, in the unit reduced to practice, was 18 inches. The fibers making up each row of bristles consisted of 45 mil diameter DuPont Tynex A nylon impregnated with aluminum oxide according to Product Code 9336-0406. There were 780 bristles used per 18 inch row and the brush contained 12 rows of bristles. Other brushes might be assembled using different diameter fibers. For example, DuPont Tynex A is available in either aluminum oxide or silicon carbide abrasive particle impregnation with several choices of fiber diameters ranging from 20 to more than 100 mils. The composition of the material to be deburred regulates the choice of fiber diameter and abrasive selected. For example, aluminum extrusions can be deburred with aluminum oxide abrasive whereas it may be preferable to deburr steel millings with silicon carbide impregnated fibers.

Figure 2:
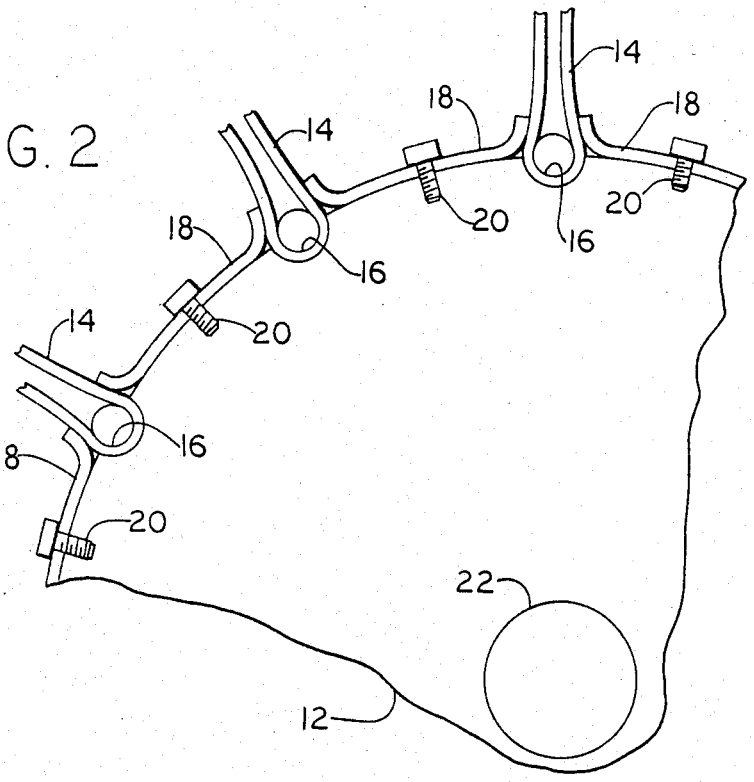
FIG. 2 is an enlarged partial end view of the brush mandrel showing one means for attaching the abrasive fibers.

In FIG. 2 is illustrated one way in which the abrasive fibers are attached to mandrel 12. Sixteen inch lengths of DuPont Tynex A were bent in the middle so as to encircle dowel rods 16 which extend the length of mandrel 12. A multiplicity of clamping plates 18 secured to mandrel 12 by screws 20 hold the fiber/dowel rod combination in place while maintaining the brush bristles in a generally erect condition. This mounting arrangement is intended as being only exemplary and bristles secured to the mandrel by other means would function equally well. In making test brushes, some were made by potting the bristles in grooves cut in the mandrel.

The finished brush 10 is configured to be rotatably mounted on mandrel axle shaft 22. The brush 10 is then rotatably driven so that the bristles overlap the sharp edges of the workpiece.

Figure 3:
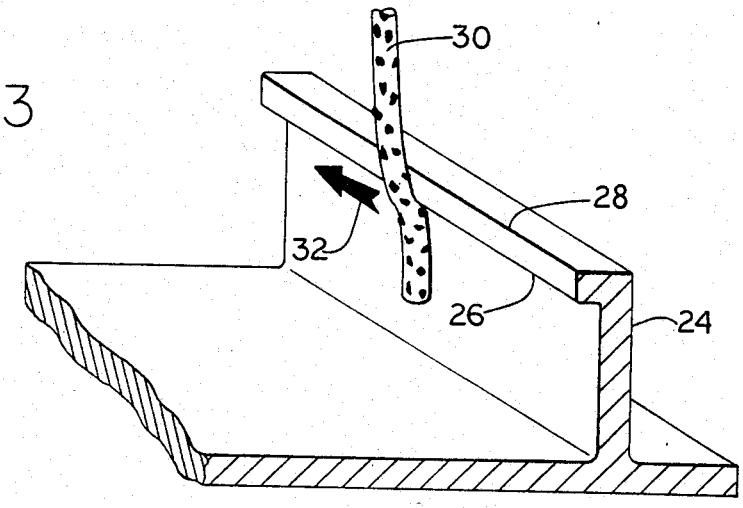
FIG. 3 depicts an abrasive fiber in contact with the sharp edge of the workpiece.

FIG. 3 is a fragmentary view of a milled extrusion 24 having sharp edges 26 and 28 which are to be deburred. One bristle 30 from a FIG. 1 brush 10 is shown in contact with milled edges 26 and 28. It is assumed that the mandrel to which bristle 30 is attached, turns so as to move the bristle in the direction shown generally by arrow 32. Thus, due to rotation of the brush mandrel, bristle 30 extending therefrom is dragged sidewise along edges 26 and 28, removing material from the workpiece with a sort of rasping action due to the abrasive particles impregnated into the flexible bristle fiber.

Figure 4:
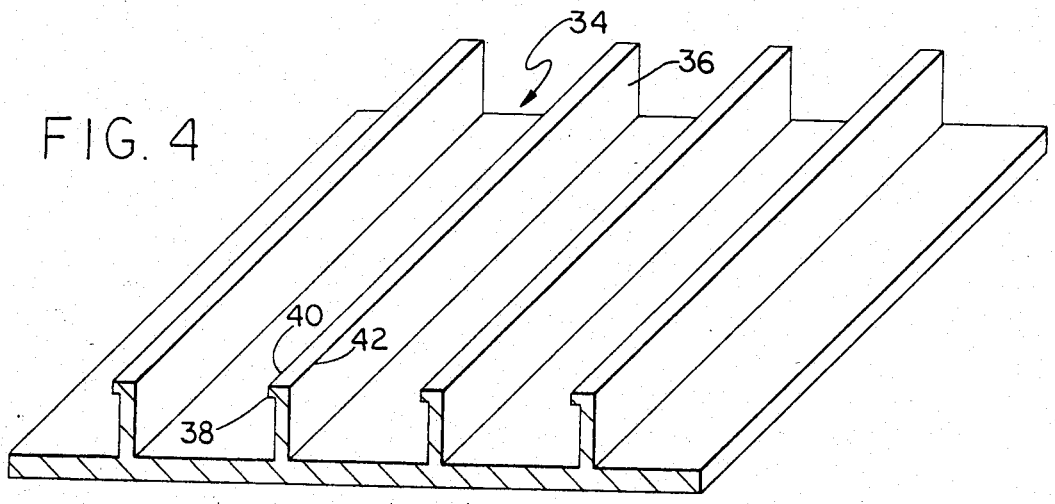
FIG. 4 is a perspective view of a typical aerospace extrusion which has been milled ready for deburring.
Figure 8:
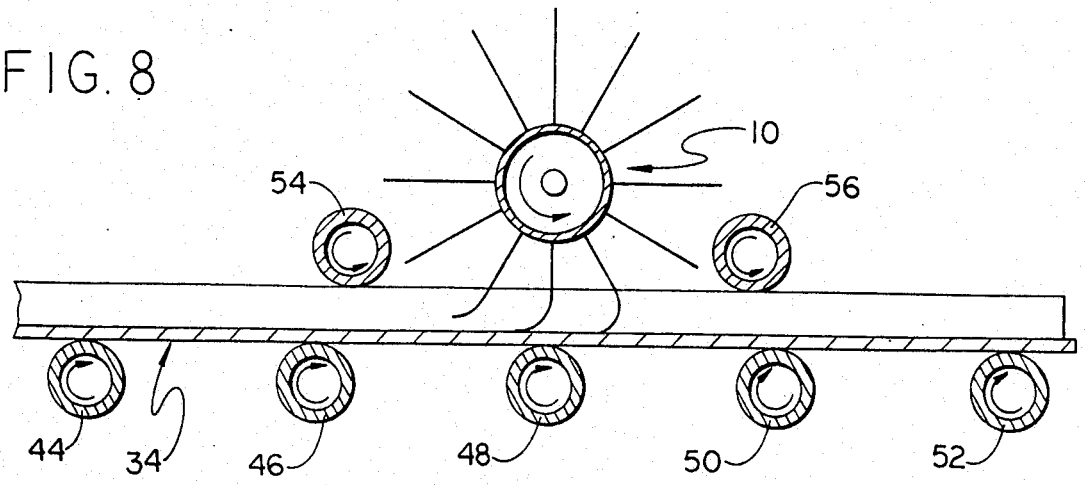
FIG. 8 is a side view of the conveyor, showing in simplified form how the workpiece is transported beneath the revolving brush.

FIG. 4 is a cross-sectional perspective view of a typical extrusion 34 which was successfully deburred by an implementation of our invention. Each strut 36 has three sharp edges 38, 40 and 42 which must be deburred as it is delivered from the cutting mill. In the system reduced to practice a conveyance arrangement was incorporated to move the FIG. 4 extrusions under the rotating brush. A cross-sectional side view of the conveyor is shown in FIG. 8. Extrusion 34 is shown supported on a plurality of parallel rollers 44, 46, 48, 50 and 52. In the unit reduced to practice, rollers 46 and 50 were driven and rollers 44, 48 and 52 were not driven but were free to turn on their respective axes. Topside rollers 54 and 56 were each pivotally mounted for rotation on arms which allowed rollers 54 and 56 to make contact with the uppermost side of extrusion 34. Air pistons (not shown) were used to actuate arms which brought rollers 54 and 56 into contact with the uppermost side of extrusion 34. Rotating brush 10 then carried out the deburring of the extrusion by being able to span the entire width of the milled section at one time. Arrows show the direction of rotation of both the rollers and the brush. In the system reduced to practice, a series of event sequencing switches was included which controlled all steps in the operation. The surfaces of rollers 44, 46, 48, 50, 52, 54 and 56 were covered with neoprene or equivalent to ensure that the workpiece being deburred was not scratched or scuffed. Rollers 46 and 50 were driven so as to provide a feed rate through the system of approximately 3 ft. per minute.

Figure 5:
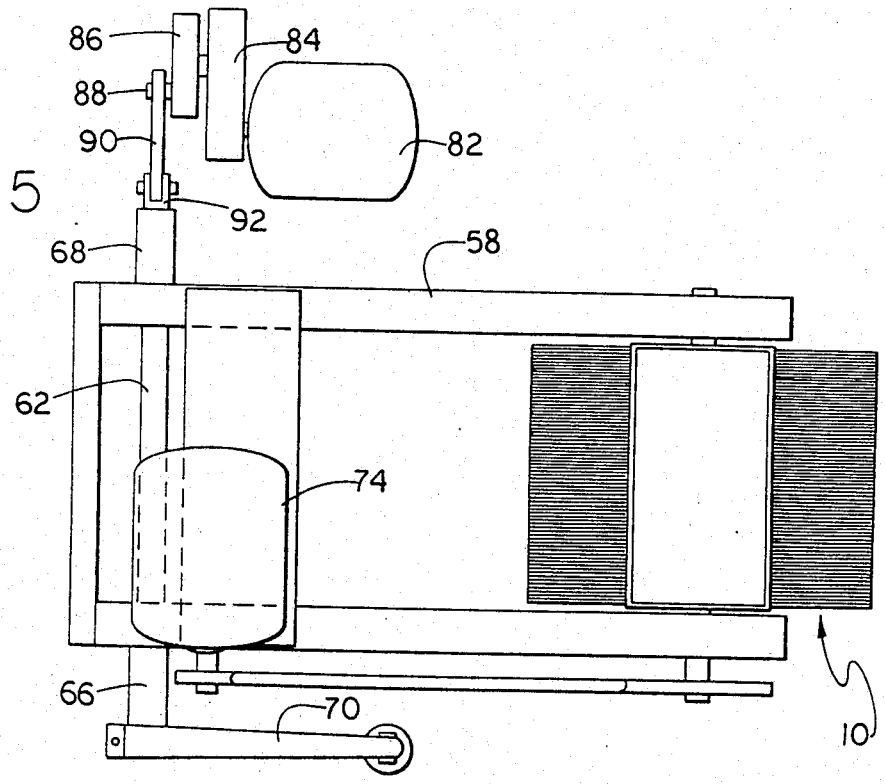
FIG. 5 is a top view of the unit assembly used to drive the FIG. 1 brush.
Figure 6:
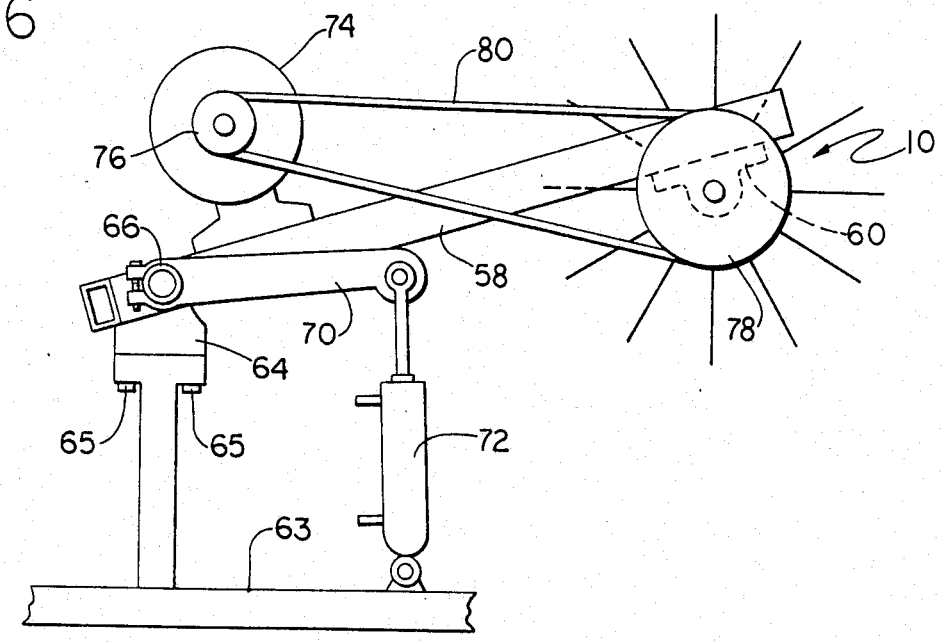
FIG. 6 is an end view of the FIG. 5 assembly.

FIGS. 5 and 6 show top and side views of the assembly which was used to actuate brush 10. There is a generally U-shaped subframe 58 to which brush 10 is rotatably attached by means of bearing mounts 60. The base end of the subframe is supported by stub shaft 62. Stub shaft 62 is secured to the main frame 63 of the machine by bolts 65 which are attached to mounting support 64. The U-shaped subframe 58 is attached to stub shaft 62 by means of sleeve bearings 66 and 68. Crankarm 70 is clamped to the exterior surface of sleeve bearing 66. The second end of crankarm 70 is attached to the piston rod of air cylinder 72 whose base is rotatably attached to main frame 63. As may be seen in FIG. 6, operation of air cylinder 72 serves to raise and lower brush 10. As implemented in the FIG. 8 system, the air cylinder 72 shown in FIG. 6 was programmed to lower brush 10 into a position where it would contact the workpiece with an overlap of at least an inch by the bristle ends.

FIGS. 5 and 6 also depicts a brush drive by first motor 74 which is secured to subframe 58 by appropriate bolts. Pulley 76 on the shaft of first motor 74 and pulley 78 on the shaft of brush 10 are properly sized so that drive belt 80 rotates brush 10 at the desired speed. In the immplementation reduced to practice, brush 10 was driven at a speed of between 600 and 700 rpm. For a 22 inch diameter brush whose bristles overlap the workpiece by at least one inch, this means the surface speed of the bristles on the workpiece is 3300 to 3850 ft/min.

In addition to rotation of brush 10, it was discovered to be advantageous to simultaneously move brush 10 endwise in an oscillatory manner. Oscillatory endwise motion was accomplished by use of second motor 82 (See FIG. 5) which is secured to frame 63 (not shown). A down-geared transmission 84 attached to the output shaft of second motor 82 provides an output to flywheel 86 having an eccentric drive 88 for oscillatory movement of pitman arm 90 whose first end is attached thereto. The second end of pitman arm 90 is rotatably secured by bolt means to a pair of brackets 92 secured to and extending outwardly from sleeve bearing 68.

Rotation of motor 82 thus causes frame 58 to move back and forth by an amount equal to twice the offset of eccentric drive 88. Oscillatory motion of frame 58 moves brush 10 endwise back and forth causing each brush bristle 30 to have a bidirectional component of motion. In the unit reduced to practice, the rotational rate of motor 82 and the step-down ratio of transmission 84 combined to provide an endwise oscillatory motion of brush 10 equalling 30 cycles per minute.

Figure 7:
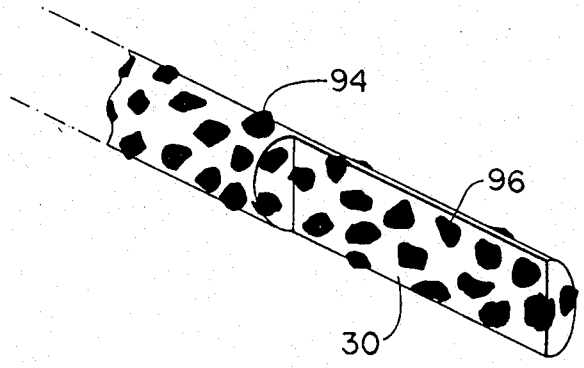
FIG. 7 is a cutaway view of one of the abrasive fibers.

FIG. 7 is an enlarged view of one of the brush bristles 30 showing a cutaway of the interior. On the left abrasive particles 94 extend through the surface of the nylon resin. In the cutaway portion on the right, abrasive particles 96 are shown to be impregnated throughout the interior of the bristle fiber. This means that as the resinous material wears away during the deburring action, abrasive material will continue to make contact with the workpiece.

While our invention has been disclosed using a brush having long bristles composed of nylon fibers impregnated with abrasive particles, the use of nylon fibers is intended only as being exemplary. Use of other materials can be considered as within the scope of our invention. The prime criteria is to use a somewhat flexible material which is both wear resistant and capable of having impregnated therein abrasive particles of a size and hardness factor which will cause deburring of the specified workpiece.

While only a single embodiment of the invention has been presented, various modifications will be apparent to those skilled in the art. For example, both the brush length and the length of the bristles thereon may be changed to fit operating conditions. Therefore, the invention should not be limited to the specific illustration disclosed, but only by the following claims.

We claim:

1. A method of deburring an edge of a structural member workpiece with a strip brush having groups of flexible bristles arranged in strips and extending normally in a generally radially extending erect condition, each bristle having a tip and being formed of abrasive impregnated fibrous material over a substantial working section extending from the tip, the length, flexibility and abrasive fibrous material of the bristles and their population density and spacing between the strips being such that when the brush is rotated axially the bristles flex axially and in the plane of rotation of the brush, the method comprising the steps of first, transporting the workpiece and the brush toward each other by relative linear motion having a component normal to the axis of rotation of said brush and second, maintaining the working sections of the bristles in contact with the edge while rotating the brush axially in a predetermined speed range so that the working sections of the bristles strike said edge and flex and make slapping overlapping contact with the workpiece and the working sections are dragged across and along the edge to cause the impregnated fibers to remove material from the edge and to deburr said edge and surfaces forming said edge.

2. The method of claim 1 further including oscillatory endwise moving said brush in the direction of said axis while the bristles are in wiping contact with said workpiece.

3. The method of claim 1 wherein said brush has a diameter such that the distance across diametrically disposed bristles is at least 20 inches, and said brush is rotated at a speed between 600 and 700 rpm.

4. The method of claim 3 wherein 12 rows of bristles are secured to a mandrel having a 6 inch diameter, the density of bristles in each row being such as to provide 780 bristles per row of 18 inch length.

5. The method of claim 1 wherein the bristles are arranged so that the overall distance across diametrically disposed bristles is at least 20 inches, and the brush is rotated so that the linear velocity of the tips of the bristles is in the range of about 3000 to 4000 feet per minute.

6. The process of deburring a structural workpiece having an edge comprising the steps of First, rotating axially a strip brush having radially extending discrete groups of flexible bristles of fibrous material having tips and working sections extending from said tips, said bristles also having abrasive particles distributed throughout said sections and Second, moving said workpiece and said strip brush relative to each other so that successive groups of bristles approach said workpiece at linear deburring speed and slap the working sections against the workpiece and flex as the working sections are dragged to wipe said edge and surfaces forming said edge, the population density of the bristles and the spacing between said groups permitting flexing of said working sections.

* * * * *